US006747538B2

(12) United States Patent
Kuwata et al.

(10) Patent No.: US 6,747,538 B2
(45) Date of Patent: Jun. 8, 2004

(54) INDUCTANCE DEVICE

(75) Inventors: Haruhiko Kuwata, Hyogo (JP); Shinichi Morimoto, Hyogo (JP); Hitoshi Iwasaki, Hyogo (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 0 days.

(21) Appl. No.: 10/204,538

(22) PCT Filed: Apr. 19, 2002

(86) PCT No.: PCT/JP02/03967

§ 371 (c)(1),
(2), (4) Date: May 20, 2003

(87) PCT Pub. No.: WO03/030191

PCT Pub. Date: Apr. 10, 2003

(65) Prior Publication Data

US 2003/0179062 A1 Sep. 25, 2003

(51) Int. Cl.[7] ..... H01F 15/02
(52) U.S. Cl. ..... 336/83; 336/212; 336/192
(58) Field of Search ..... 336/83, 192, 212, 336/96, 200

(56) References Cited

U.S. PATENT DOCUMENTS 4,314,221 A * 2/1982 Satou et al. ..... 336/83
5,382,937 A * 1/1995 Saitoh et al. ..... 336/178
5,572,788 A * 11/1996 Saitoh et al. ..... 29/605
5,751,203 A * 5/1998 Tsutsumi et al. ..... 336/65
6,538,546 B2 * 3/2003 Serino et al. ..... 336/96
6,583,699 B2 * 6/2003 Yokoyama ..... 336/83

FOREIGN PATENT DOCUMENTS

| | | | |
|---|---|---|---|
| EP | 0 945 880 | 9/1999 | |
| JP | 10-294221 | 11/1998 | |
| JP | 02000340428 A | * 12/2000 | ..... H01F/17/04 |
| JP | 02002231533 A | * 8/2002 | ..... H01F/27/06 |

OTHER PUBLICATIONS

Patent Abstracts of Japan, vol. 2000, No. 08, Oct. 6, 2000 & JP 2000 150244 A (Tokyo Coil Engineering KK), May 30, 2000, Abstract; figures.
Patent Abstracts of Japan, vol. 1995, No. 11, Dec. 26, 1995 & JP 07 220929 A(Sumida Denki KK), Aug. 18, 1995, abstract.

* cited by examiner

*Primary Examiner*—Anh Mai
(74) *Attorney, Agent, or Firm*—Wenderoth, Lind & Ponack, L.L.P.

(57) ABSTRACT

An inductance device includes terminals (9) which are mounted to the inductance device from outside of a ring core (7). A fit-section (12) of one of each terminal (9) is bent along an outer wall (14), an upper face (15) of a groove (19), and an inner wall (13) of the ring core (7). A mount-section (11) of one of each terminal (9) extends from vicinity of an outer perimeter of the ring core (7) toward inside of a drum core (4) along a lower brim (3). When a shock is applied to the drum core (4) or the ring core (7), this structure prevents the drum core (4) and the ring core (7) from falling away from a board, where they have been mounted, leaving vicinity of the fit-section (12) of the terminal (9) on the board. This structure thus improves shock-proofness of the inductance device.

18 Claims, 7 Drawing Sheets

INDUCTANCE DEVICE

TECHNICAL FIELD

The present invention relates to an inductance device used in various electronic apparatuses.

BACKGROUND ART

A conventional inductance device is described hereinafter with reference to the accompanying drawings. Japanese Patent Application Non-Examined Application No. H10-294221 discloses one of the conventional inductance devices. FIG. 10 is a perspective bottom view of the conventional inductance device, and FIG. 11 is an exploded perspective view of the inductance device shown in FIG. 10.

In FIG. 10 and FIG. 11, the conventional inductance device comprises the following elements:

drum core 24;

winding 25;

ring core 26; and terminals 27.

Drum core 24 has upper brim 22 on a first end of roller shaft 21 and lower brim 23 on a second end of roller shaft 21. Diameters of those two brims are approx. the same. Winding 25 is wound on shaft 21. Ring core 26 has a sectional view of a ring shaped hollow-cylinder, and is disposed outside drum core 24. Ring core 26 is fixed to drum core 24 with adhesive. Respective two terminals 27 are mounted to ring core 26, and electrically connected to the two winding-ends.

One of each terminal 27 has mount-section 28 to be mounted to a board of an apparatus, and fit-section 29 to be fitted to ring core 26. Each terminal 27 is fitted to ring core 26 from the outside such that the two terminals are on diagonally opposite positions.

When this conventional inductance device is mounted on a board, drum core 24 is positioned such that a space is provided between lower brim 23 and the board.

In this conventional structure, drum core 24 and ring core 26 are supported by only two fit-sections 29, and mounted to the board. In general, cores 24 and 26 are fragile because they are made of sintered magnetic material such as ferrite. Therefore, when a shock is applied to this conventional inductance device, cracks occur on ring core 26 around fit-section 29. Both of drum core 24 and ring core 26 thus sometimes fall away from the board leaving vicinity of fit-sections 29 of terminals 27 on the board. As such, the conventional inductance devices are vulnerable to shocks.

DISCLOSURE OF THE INVENTION

The present invention addresses to the problem discussed above, and aims to provide an inductance device of which shock-proofness is improved. The inductance device of the present invention is thus free from falling away from a mounted-board with fit-sections of terminals left on the board when a shock is applied to the drum core or the ring core.

The inductance device of the present invention comprises the following elements:

(a) a drum core having an upper brim on a first end of a roller shaft and a lower brim on a second end of the roller shaft;

(b) a winding wound on the roller shaft;

(c) a ring core having grooves, disposed outside the drum core and fixed to the drum core; and (d) terminals, for connecting electrically the winding thereto, including:

(d-1) fit-sections for fitting the terminals to the ring core by putting parts of the respective fit-sections into the grooves; and (d-2) mount-sections, for mounting the inductance device to an apparatus, linked to the respective fit-sections and extending inward along the lower brim of the drum core from near perimeter of the ring core.

When a shock is applied to the inductance device of the present invention, the structure discussed above allows the shock applied to the drum core or the ring core to disperse into the mount-sections of the terminals. The stresses applied to the fit-sections of the terminals are thus relaxed. As a result, cracks on the ring core around the fit-sections can be restrained, and the shock-proofness of the inductance device is improved.

BRIEF DESCRIPTIONS OF DRAWINGS

DETAILED DESCRIPTIONS OF EXEMPLARY EMBODIMENTS

The exemplary embodiments of the present invention are demonstrated hereinafter with reference to the accompanying drawings.

First Exemplary Embodiment

Figure 1:
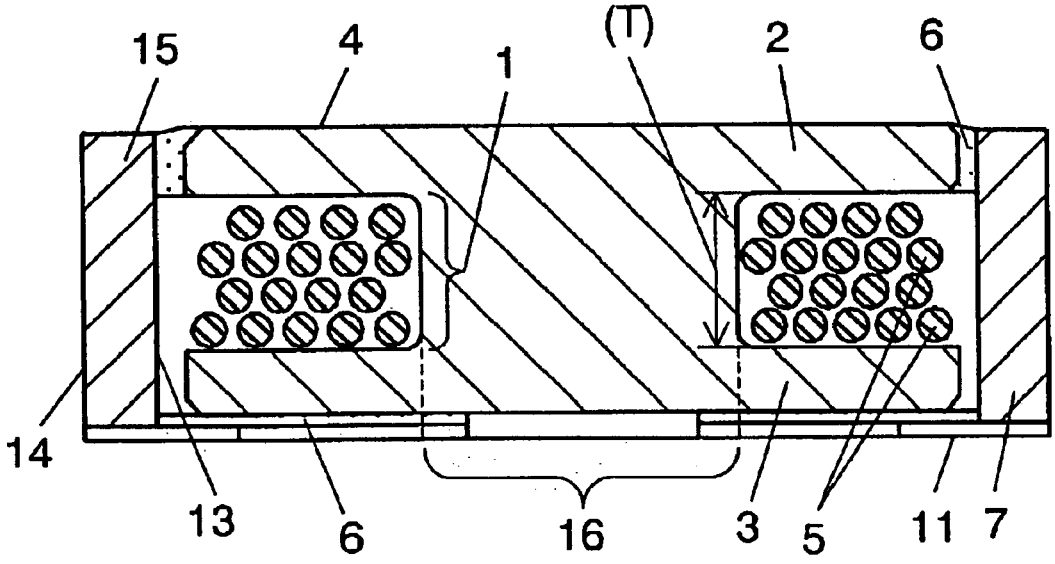
FIG. 1 is a sectional view of an inductance device in accordance with a first exemplary embodiment.
Figure 2:
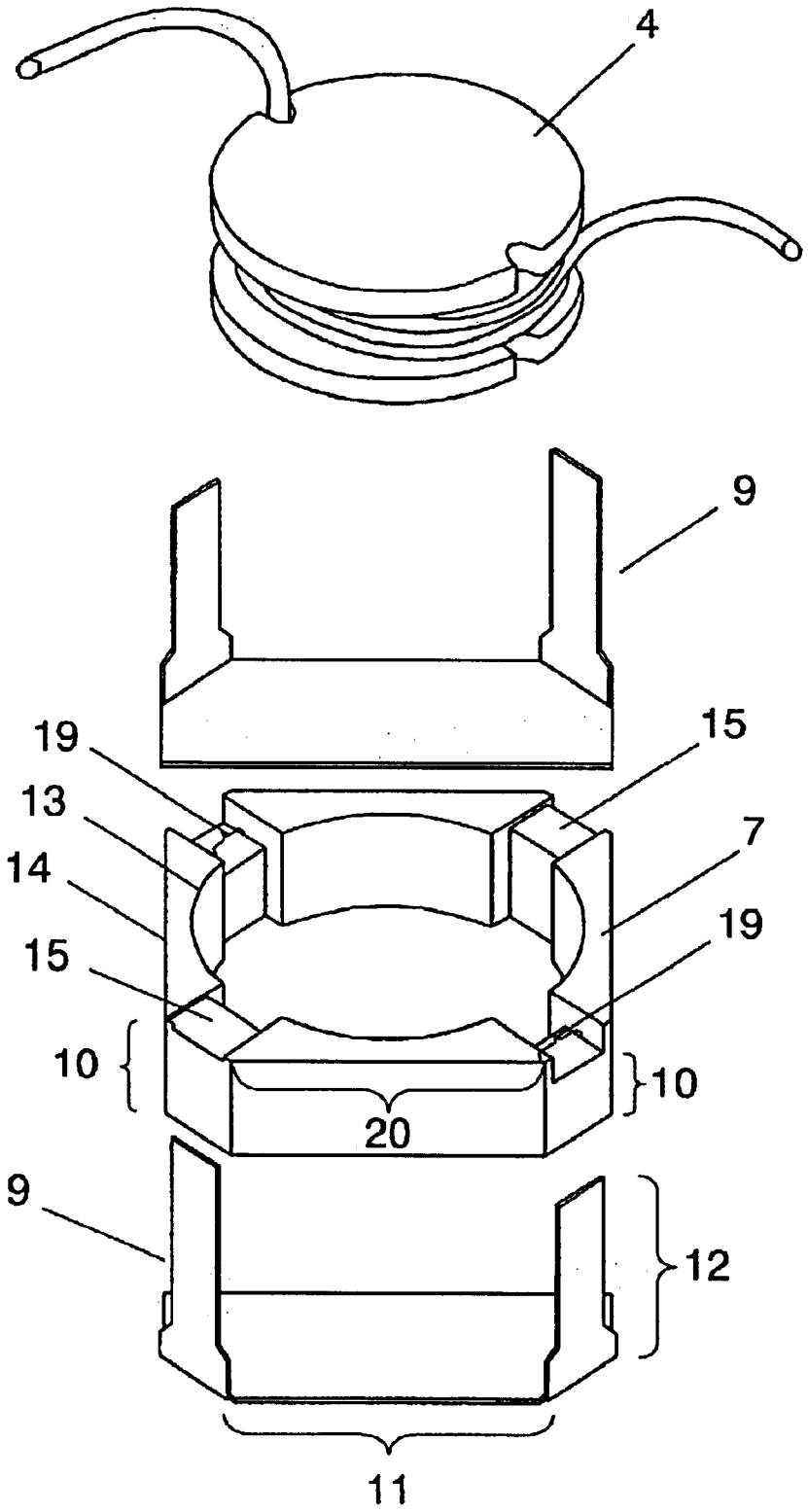
FIG. 2 is an exploded perspective view of the inductance device shown in FIG. 1.
Figure 3:
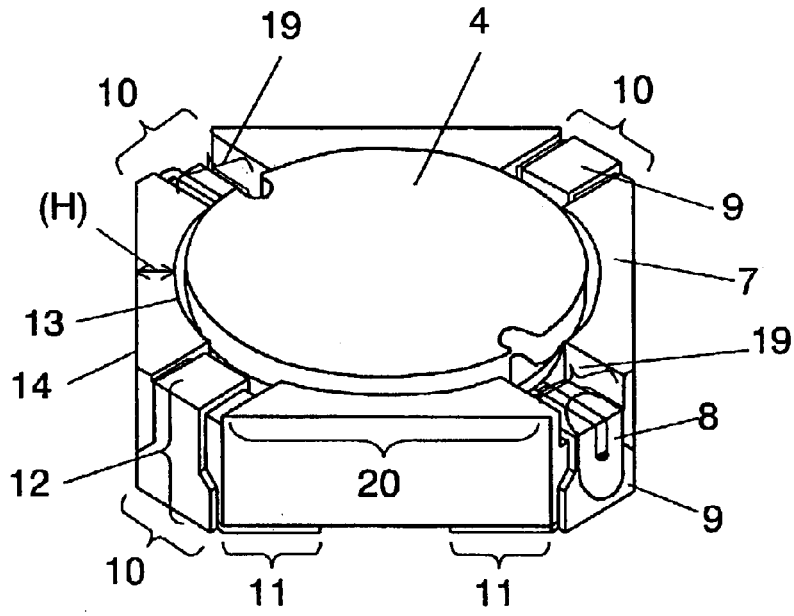
FIG. 3 is a perspective view of the inductance device shown in FIG. 1.
Figure 4:
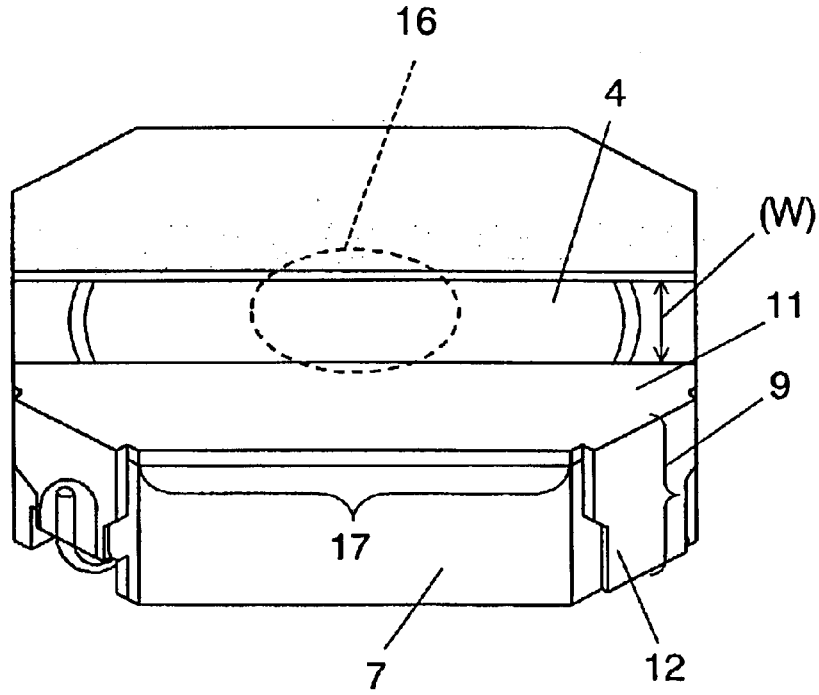
FIG. 4 is a perspective bottom view of the inductance device shown in FIG. 1.
Figure 5:
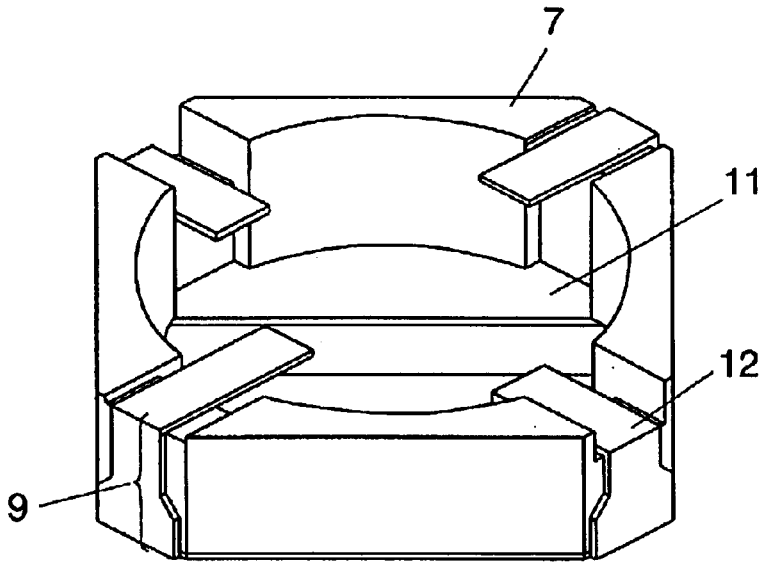
FIG. 5 is a perspective view illustrating the terminals in process of being fitted to the ring core of the inductance device shown in FIG. 1.
Figure 6:
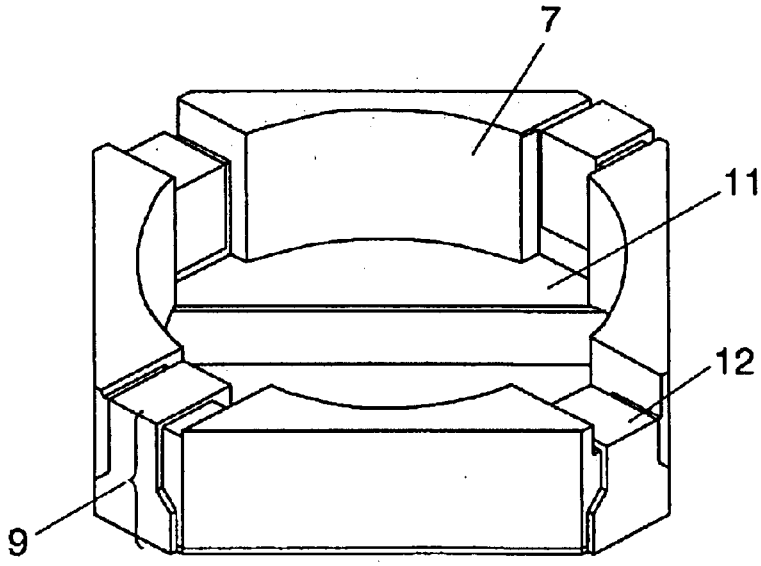
FIG. 6 is a perspective view illustrating the terminals fitted to the ring core of the inductance device shown in FIG. 1.

FIG. 1 is a sectional view of an inductance device in accordance with the first exemplary embodiment. FIG. 2 is an exploded perspective view of the inductance device shown in FIG. 1. FIG. 3 is a perspective view of the same inductance device. FIG. 4 is a perspective bottom view of the same inductance device. FIG. 5 is a perspective view illustrating the terminals in process of being fitted to the ring core of the same inductance device. FIG. 6 is a perspective view illustrating the terminals fitted to the ring core of the same inductance device.

In FIG. 1 through FIG. 6, the inductance device in accordance with the first embodiment has the following dimensions:

6 mm square, height: 1.5 mm, and diameter of the drum core: 5 mm.

A first end of roller shaft 1 of drum core 4 has upper brim 2, and a second end of roller shaft 1 has lower brim 3. Roller shaft 1 is wound with winding 5. Ring core 7 is disposed outside drum core 4, and ring core 7 is fixed to drum core 4 with adhesive 6.

Ring core 7 has groove 19 at four corners 10 chamfered, as shown in FIG. 2, and has four sides 20 between the corners on a substantially quadrangle-shaped plane. The points, on the four sides 20, having thinnest distance "H" (refer to FIG. 3) between inner wall 13 and outer wall 14 are located at respective centers of adjacent corners 10.

Further, each terminal 9 has one mount-section 11 and two fit-sections 12 linked to mount-section 11. Mount-section 11 is used for being mounted to a board of an apparatus, and two fit-sections 12 are used for being fitted to ring core 7. A part (upper part) of each fit-section 12 is put onto groove 19 provided to ring core 7.

First fit-section 12 out of the two fit-sections is electrically connected to winding 5 with solder 8 on first groove 19 out of two grooves, where first groove 19 is deeper than second groove 19.

The upper part of fit-section 12, in particular, is bent along outer wall 14 and upper face 15 of groove 19, and a tip of the upper part is further bent along upper face 15 and inner wall 13, whereby each terminal 9 is fitted to ring core 7 from the outside. Mount-section 11 of each terminal 9 extends from vicinity of outer perimeter of ring core 7 toward inside of drum core 4. As shown in FIGS. 1 and 4, extending mount-section 11 further extends over a place 16, corresponding to the outer wall of roller shaft 1, to further inside of drum core 4. The mount-section is preferably extends as far as to place 16.

The structure of mount-section 11 discussed above allows each one of two mount-sections 11 to form a substantial quadrangle which covers lower brim 3 of drum core 4 and a lower face of ring core 7. Distance "W" between two mount-sections 11 opposite to each other is at least 1 mm, as shown in FIG. 4.

Further, a height of drum core 4 is approx. the same as that of ring core 7. In a space of approx. 0.1 mm between upper brim 2 of core 4 and inner wall 13 of core 7 opposite to upper brim 2, elastic adhesive 6 is applied along inner wall 13. Drum core 4 is thus fixed to ring core 7. Adhesive 6 is also applied to a space between mount-section 11 and lower brim 3 of drum core 4, and a space between mount-section 11 and lower part of ring core 7, in order to fix these elements to each other.

Outer diameters of upper brim 2 and lower brim 3 are not less than 2 times an outer diameter of roller shaft 1. In this case, the diameter of roller shaft 1 is 2.2 mm, and each outer diameter of brims 2 and 3 is 5 mm. An inner diameter of ring core 7 is not less than three times a height of core 7. In this case, the height is 1.5 mm, and the inner diameter is 5.2 mm. A depth of upper and lower brims is 0.4 mm each, and a width (T) of shaft 1 shown in FIG. 1 is 0.6 mm.

In the inductance device in accordance with the first embodiment, mount-sections 11 of terminals 9 extend from the vicinity of outer perimeter 17 of ring core 7 up to place 16 corresponding to the outer wall of roller shaft 1, or extend over place 16 and to further inside of drum core 4. When a shock is applied to the inductance device, e.g., the shock is applied to upper brim 2 toward lower brim 3, the structure discussed above allows mount-section 11 extending up to place 16 to support drum core 4. In other words, the shock applied to drum core 4 or ring core 7 disperses into mount-sections 11 of terminals 9, so that the stress applied to fit-section 12 can be relaxed. As a result, cracks at the vicinity of fit-sections 12 are restrained, and shock-proofness is improved.

Since mount-section 11, in particular, extends along lower brim 3 up to place 16 which has enough strength, this structure prevents lower brim 3 from being cracked due to a heavy shock although the shock is dispersed. This structure can thus positively improve the shock-proofness.

Ring core 7 has four corners 10 where groove 19 is formed respectively. Every side 20 between adjacent corners 10 is formed on one square plane, and an upper part of respective fit-sections 12 is put into each groove 19. This structure prevents stress from concentrating on each side 20. Therefore, strength around each fit-section 12 of ring core 7 is maintained, and cracks on ring core 7 can be further restrained. In this structure, since each fit-section 12 is fitted to respective grooves 19, fit-section 12 can be positioned correctly.

Further, adhesive 6 is applied to the space between mount-section 11 and lower brim 3, and the space between a lower part of ring core 7 and mount section 11. This structure improves the shock-proofness not only against cracks due to the shock applied to upper brim 2 toward lower brim 3, but also against cracks due to every possible shock.

A space between upper brim 2 of drum core 4 and ring core 7, adhesive 6 is applied along inner wall 13 of ring core 7 not only to a specified part but also the entire space. A shock thus does not concentrate on a specific part but the shock disperses substantially uniform between core 4 and core 7. This structure restrains cracks from happening around the bonded section between core 4 and core 7, and improves shock-proofness. Since elastic adhesive is used, the shock can be also dispersed into adhesive 6. This structure thus further improves the shock-proofness.

Each fit-section 12 of respective terminals 9 bends along outer wall 14 of ring core 7, upper face 15 of groove 19 and inner wall 13. Fit-section 12 runs on upper face 15 (i.e., fit-section 12 is brought into contact with upper face 15). When a shock is applied to upper brim 2 toward lower brim 3, this structure disperses the shock from upper face 15 of groove 19 into inner wall 13 and outer wall 14. In other words, fit-section 12 can efficiently disperse the shock.

Besides this advantage, each fit-section 12 is caulked to ring core 7, therefore, even if a shock in any direction is applied, this structure positively improves the shock-proofness.

One terminal 9 has two fit-sections 12, therefore, stress due to a shock is dispersed into two fit-sections 12, and the shock-proofness is thus improved. Since one terminal 9 has one mount-section 11, this structure does not lower the efficiency of mounting the inductance device onto the board. Since one of each mount-section 11 shapes in a substantial quadrangle which covers bottoms of lower brim 3 and ring core 7, this structure improves the efficiency of mounting the inductance device onto the board. When a shock is applied to drum core 4 and ring core 7, the shock tends to disperse into mount-sections 11. This structure thus further prevents cracks of ring core 7 around fit-sections 12.

Since core 4 and core 7 have approx. the same height, core 4 is fixed to core 7 with adhesive 6 correctly, which allows magnetic flux to flow smooth from core 4 to core 7. This structure realizes a low profile and improves magnetic characteristics of the inductance device.

The outer diameters of upper brim 2 and lower brim 3 are not less than two times that of roller shaft 1, and the inner diameter of ring core 7 is not less than three times the height thereof. Therefore, upper and lower brims of larger outer diameters can be employed, which results in more turns of winding 5. As a result, this structure can increase an inductance value as well as realize a low profile of the inductance device.

Second Exemplary Embodiment

Figure 7:
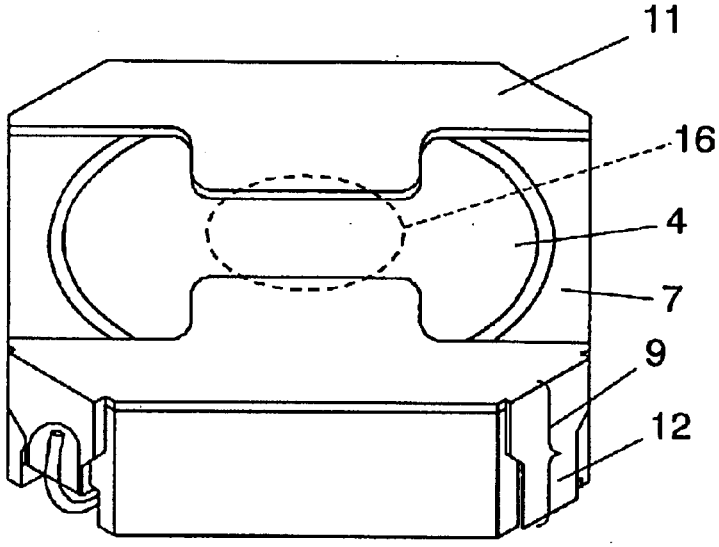
FIG. 7 is a perspective bottom view of an inductance device having T-shaped mount-sections of terminals in accordance with a second exemplary embodiment of the present invention.

FIG. 7 is a perspective bottom view of an inductance device having T-shaped mount-sections of terminals in accordance with the second exemplary embodiment of the present invention. The second embodiment differs from the first one in a shape of two terminals 9.

In the second embodiment, each terminal 9 has T-shaped mount-section 11. A tip part of mount-section 11 extends from the vicinity of outer perimeter of ring core 7 toward inside of drum core 4. As shown in FIG. 7, the extending tip part further extends over place 16 corresponding to an outer wall of roller shaft 1 and to further inside of drum core 4. The extending tip part preferably reaches as far as place 16. The second embodiment can produce the same advantage as the first one.

Third Exemplary Embodiment

Figure 8:
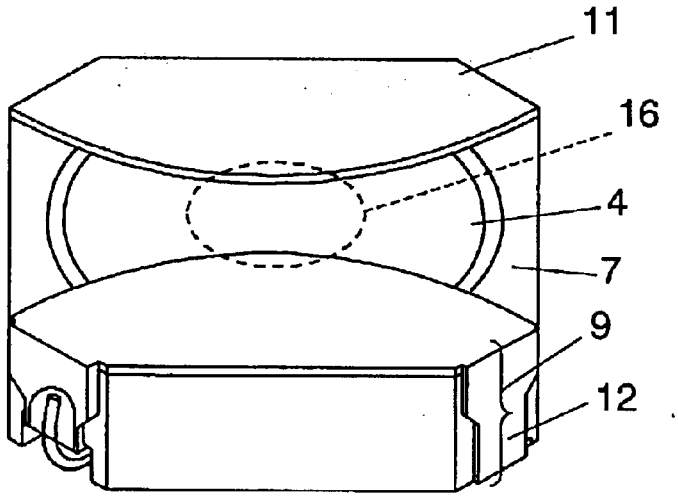
FIG. 8 is a perspective bottom view of an inductance device having arc-shaped mount-sections of terminals in accordance with a third exemplary embodiment of the present invention.

FIG. 8 is a perspective bottom view of an inductance device having arc-shaped mount-sections of terminals in accordance with the third exemplary embodiment of the present invention. The third embodiment differs from the first one in a shape of two terminals 9.

In the third embodiment, each terminal 9 has arc-shaped mount-section 11. A tip part of mount-section 11 extends from the vicinity of outer perimeter of ring core 7 toward inside of drum core 4. As shown in FIG. 8, the extending tip part further extends over place 16 corresponding to an outer wall of roller shaft 1 and to further inside of drum core 4. The extending tip part preferably reaches as far as place 16. The third embodiment can produce the same advantage as the first one.

Fourth Exemplary Embodiment

Figure 9:
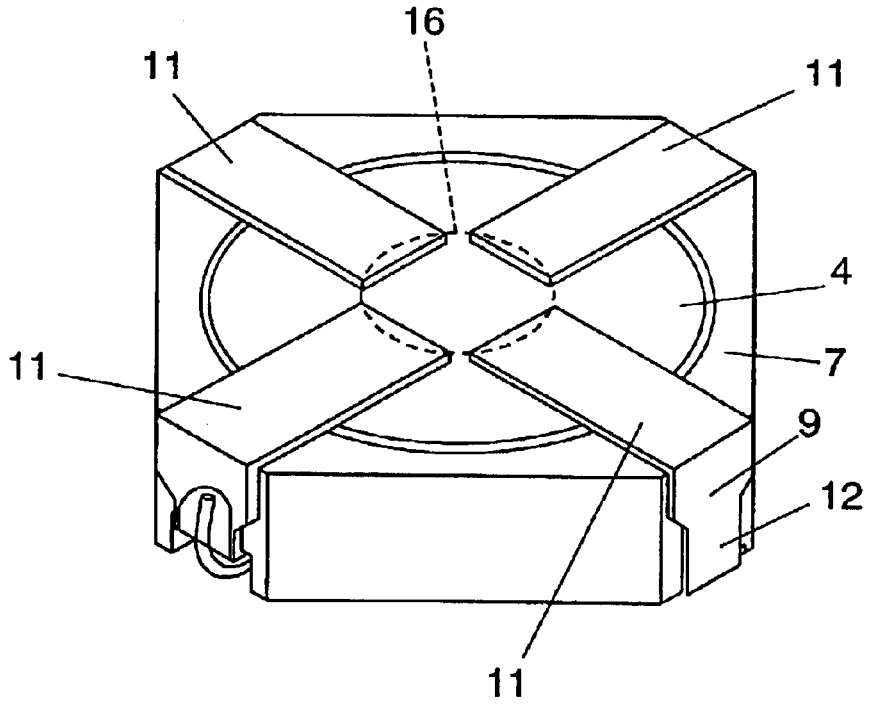
FIG. 9 is a perspective bottom view of an inductance device having four terminals in accordance with a fourth exemplary embodiment of the present invention.
Figure 10:
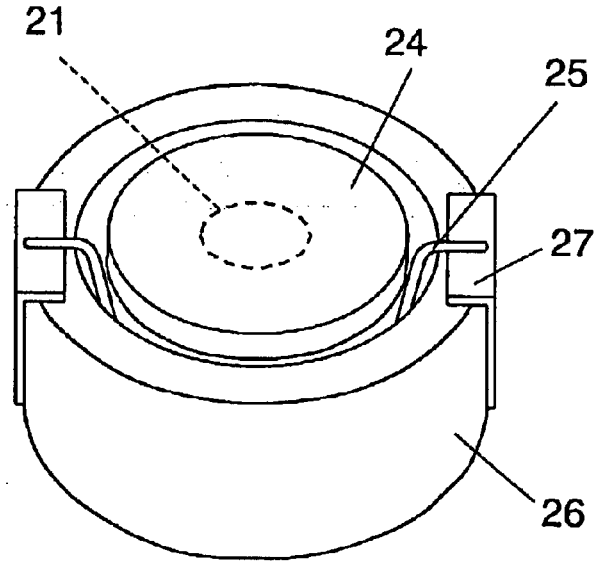
FIG. 10 is a perspective bottom view of a conventional inductance device.
Figure 11:
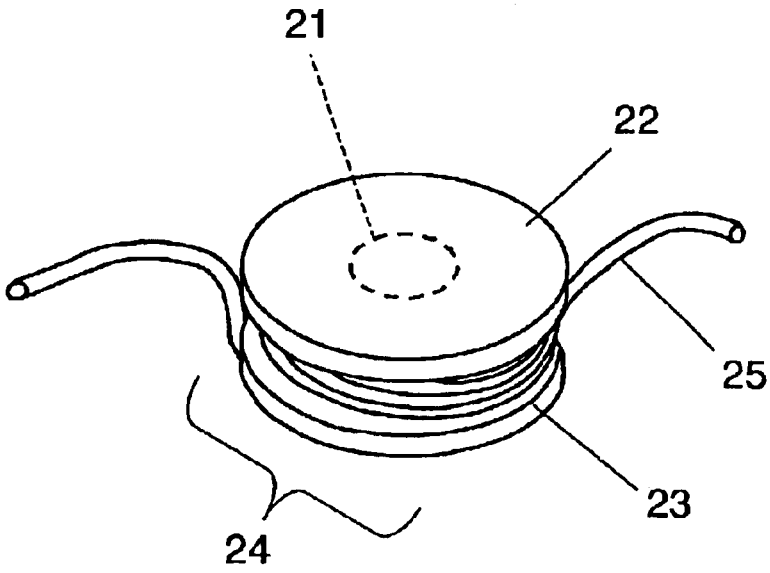
FIG. 11 is an exploded perspective view of the conventional inductance device shown in FIG. 10.
Figure 11:
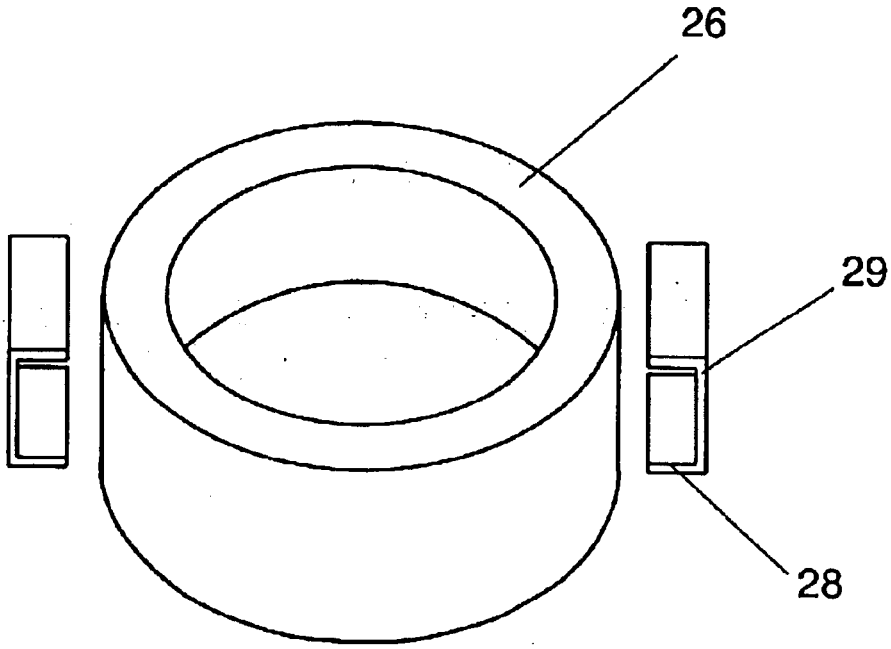

FIG. 9 is a perspective bottom view of an inductance device having four terminals in accordance with the fourth exemplary embodiment of the present invention. The fourth embodiment differs from the first one in a number and a shape of terminals 9.

In the fourth embodiment, four terminals 9 are prepared, and mount-section 11 of each terminal 9 shapes in a substantial quadrangle. A tip part of each mount section 11 extends from the vicinity of outer perimeter of ring core 7 toward inside of drum core 4. As shown in FIG. 9, the extending tip part further extends over place 16 corresponding to an outer wall of roller shaft 1 and to further inside of drum core 4. The extending tip part preferably reaches as far as place 16. The fourth embodiment can produce the same advantage as the first one.

Industrial Applicability

A shock applied to a drum core or a ring core disperses into respective mount-sections of terminals, the stress to each fit-section of the terminals is thus relaxed. This structure can restrain cracks of the ring core from happening around each fit-section. Each mount-section extends from the vicinity of an outer perimeter of the ring core toward inside the drum core and reaches as far as a place, which has enough strength, corresponding to an outer wall of a roller shaft. This structure prevents a lower brim of the drum core from cracking due to a heavy shock although it is dispersed.

As a result, the present invention can provide an inductance device of improved shock-proofness. In this inductance device, when a shock is applied to the drum core or the ring core, they do not fall away from the board leaving the vicinity of the fit-sections on the board.

What is claimed is:

1. An inductance device comprising:

(a) a drum core (4) including an upper brim (2) at a first end of roller shaft (1) and a lower brim (3) at a second end of shaft (1);

(b) a winding (5) wound on the roller shaft (1);

(c) a ring core (7) including a groove (19), disposed outside said drum core (4) and fixed to said drum core (4); and (d) a terminal (9), for coupling electrically said winding (5) thereto, including:

(d-1) a fit-section (12) for fitting said terminal (9) to said ring core (7) by putting a part of said fit-section (12) to the groove (19); and (d-2) a mount-section (11), for mounting said inductance device to an apparatus, linking to said fit-section (12) and extending from vicinity of outer perimeter of said ring core (7) toward inside of said drum core (4) along the lower brim (3).

2. The inductance device of claim 1, wherein said mount-section (11) extends from the vicinity of the outer perimeter of said ring core (7) to one of a place within said drum core (4), the place (16) corresponding to an outer wall of the roller shaft (1), and over the place (16) to further inside of said drum core (4).

3. The inductance device of claim 2, wherein said mount-section (11) shapes in a substantial quadrangle.

4. The inductance device of claim 2, wherein said mount-section forms a T-shape.

5. The inductance device of claim 2, wherein said mount-section forms an arc-shape.

6. The inductance device of claim 1, wherein said ring core (7) includes four corners (10) having one groove (19)

each, and respective sides (20) between the adjacent corners (10) are formed on one substantial square plane.

7. The inductance device of claim 6, wherein said each terminal (9) includes two fit-sections (12) and one mount-section (11), and the two fit-sections (12) are respectively put on the grooves (19) of the adjacent corners (10).

8. The inductance device of claim 7, wherein a first fit-section (12) out of the two fit-sections (12) is electrically coupled to said winding (5) on upper face (15) of a first groove (19), and the first groove (19) is deeper than a second groove (19).

9. The inductance device of claim 1, wherein a part of said fit-section (12) is bent along an outer wall (14) of said ring core (7), an upper face (15) of the groove (19) and an inner wall (13) of said ring core (7).

10. The inductance device of claim 9, wherein said terminal (9) is mounted to said ring core (7) by caulking said fit-section (12) to the groove (19).

11. The inductance device of claim 1, wherein said drum core (4) is fixed to said ring core (7) with adhesive (6) in between.

12. The inductance device of claim 11, wherein said drum core (4) is fixed to said ring core (7) by applying the adhesive (6) between the lower brim (3) of said drum core (4) and a lower part of said ring core (7).

13. The inductance device of claim 11, wherein said drum core (4) is fixed to said ring core (7) by applying the adhesive (6) between the upper brim (2) of said drum core (4) and an inner wall (13) of said ring core (7), the inner wall (13) facing the upper brim (2).

14. The inductance device of claim 11, wherein the adhesive (6) is elastic.

15. The inductance device of claim 1, wherein said drum core (4) has an identical height to that of said ring core (7).

16. The inductance device of claim 1, wherein outer diameters of the upper brim (2) and the lower brim (3) are at least two times an outer diameter of the roller shaft (1).

17. The inductance device of claim 1, wherein an inner diameter of said ring core (7) is at least three times a height of said ring core (7).

18. The inductance device of claim 1, wherein four terminals (9) are prepared, and said mount-section (11) extends from vicinity of an outer perimeter of said ring core (7) to one of a place (16) within said drum core (4), the place (16) corresponding to an outer wall of the roller shaft (1), and over the place (16) to further inside of said drum core (4).

* * * * *